US009873982B2

(12) United States Patent
Harrington et al.

(10) Patent No.: US 9,873,982 B2
(45) Date of Patent: Jan. 23, 2018

(54) METHOD OF INCREASING DRAINAGE PERFORMANCE OF A PULP SLURRY DURING MANUFACTURE OF PAPER PRODUCTS, AND PRODUCTS THEREFROM

(71) Applicants: Solenis Technologies, L.P., Schaffhausen (CH); UPM-Kymmene Corporation, Helsinki (FI)

(72) Inventors: John C. Harrington, Newark, DE (US); Kate Marritt Lusvardi, Chadds Ford, PA (US); Fushan Zhang, Hockessin, DE (US)

(73) Assignee: Solenis Technologies, L.P. (CH)

( * ) Notice: Subject to any disclaimer, the term of this patent is extended or adjusted under 35 U.S.C. 154(b) by 0 days.

(21) Appl. No.: 14/880,873

(22) Filed: Oct. 12, 2015

(65) Prior Publication Data

US 2017/0101740 A1 Apr. 13, 2017

(51) Int. Cl.

| | |
|---|---|
| ***D21H 17/25*** | (2006.01) |
| ***D21H 17/43*** | (2006.01) |
| ***D21H 21/10*** | (2006.01) |
| ***D21H 17/44*** | (2006.01) |
| ***D21H 17/42*** | (2006.01) |
| ***D21H 23/04*** | (2006.01) |
| ***D21H 17/00*** | (2006.01) |
| ***D21H 17/45*** | (2006.01) |
| ***D21H 17/37*** | (2006.01) |
| ***D21H 11/18*** | (2006.01) |
| ***D21H 17/38*** | (2006.01) |

(52) U.S. Cl.

CPC ..... *D21H 17/25* (2013.01); *D21H 3/00* (2013.01); *D21H 11/18* (2013.01); *D21H 17/37* (2013.01); *D21H 17/375* (2013.01); *D21H 17/38* (2013.01); *D21H 17/42* (2013.01); *D21H 17/43* (2013.01); *D21H 17/44* (2013.01); *D21H 17/45* (2013.01); *D21H 17/72* (2013.01); *D21H 21/10* (2013.01); *D21H 23/04* (2013.01)

(58) Field of Classification Search

USPC ..... 162/68.1–168.3, 177, 183, 185

See application file for complete search history.

(56) References Cited

U.S. PATENT DOCUMENTS

| | | | |
|---|---|---|---|
| RE22,474 | E | 5/1944 | Fryer et al. |
| 3,284,393 | A | 11/1966 | Vanderhoff et al. |
| RE28,576 | E | 10/1975 | Anderson et al. |
| 4,388,150 | A | 6/1983 | Sunden et al. |
| 4,753,710 | A | 6/1988 | Langley et al. |
| 5,167,766 | A | 12/1992 | Honig et al. |
| 5,171,808 | A | 12/1992 | Ryles et al. |
| 5,185,206 | A | 2/1993 | Rushmere |
| 5,274,055 | A | 12/1993 | Honig et al. |
| 6,310,157 | B1 | 10/2001 | Heard et al. |
| 6,391,156 | B1 | 5/2002 | Hjalmarson et al. |
| 6,395,134 | B1 | 5/2002 | Chen et al. |
| 6,524,439 | B2 | 2/2003 | Chen et al. |
| 6,602,992 | B1 | 8/2003 | Dallos et al. |
| 6,602,994 | B1 | 8/2003 | Cash et al. |
| 7,250,448 | B2 | 7/2007 | Walchuk et al. |
| 7,396,874 | B2 | 7/2008 | Hollomon et al. |
| 8,480,853 | B2 | 7/2013 | Ban |
| 8,764,939 | B2 | 7/2014 | Laine et al. |
| 2004/0143039 | A1 | 7/2004 | Hollomon et al. |
| 2013/0180679 | A1 | 7/2013 | Laine et al. |

FOREIGN PATENT DOCUMENTS

| | | | |
|---|---|---|---|
| EP | 2319984 | A1 | 5/2011 |
| WO | WO 1998/29604 | A1 | 7/1998 |
| WO | WO 2000/47628 | A2 | 8/2000 |
| WO | WO 2001/34909 | A1 | 5/2001 |
| WO | WO 2003/050152 | | 6/2003 |
| WO | WO 2012/098296 | | 7/2012 |
| WO | WO 2013/072550 | | 5/2013 |
| WO | WO 2013/089638 | A1 | 6/2013 |
| WO | WO 2014/055780 | A1 | 4/2014 |
| WO | WO 2014/147295 | A1 | 9/2014 |

OTHER PUBLICATIONS

US 8,668,809, 03/2014, Juppo et al. (withdrawn)

Lara-Ceniceros et al, Synthesis, characterization and rheological properties of three different associative polymers obtained by micellar polymerization, Polymer Bulletin, 58:425-433 (2007).*

International Search Report and Written Opinion for PCT/US15/055155, dated Aug. 8, 2016.

Allcock and Lampe, Contemporary Polymer Chemistry, (Englewood Cliffs, N. J., Prentice-Hall, 1981), chapters 3-5.

* cited by examiner

*Primary Examiner* — Dennis Cordray

(74) *Attorney, Agent, or Firm* — Joanne Rossi; Michael Herman

(57) ABSTRACT

A method of increasing the drainage performance of a pulp slurry during the manufacture of paper products by adding (a) at least one microfibrillated cellulose and (b) at least one associative polymer or at least one branched or crosslinked copolymer to the pulp slurry. This addition occurs before the dewatering step where the pulp slurry is formed into a fibrous mat.

17 Claims, No Drawings

METHOD OF INCREASING DRAINAGE PERFORMANCE OF A PULP SLURRY DURING MANUFACTURE OF PAPER PRODUCTS, AND PRODUCTS THEREFROM

CROSS REFERENCE TO RELATED APPLICATIONS/INCORPORATION BY REFERENCE STATEMENT

Not Applicable.

STATEMENT REGARDING FEDERALLY SPONSORED RESEARCH AND DEVELOPMENT

Not Applicable.

FIELD

The presently disclosed and/or claimed inventive concept(s) relates generally to a method of increasing the drainage performance of a pulp slurry during the manufacture of paper products by adding (a) at least one microfibrillated cellulose and (b) at least one associative polymer or at least one branched or crosslinked copolymer to the pulp slurry. This addition occurs before the dewatering step where the pulp slurry is formed into a fibrous mat.

BACKGROUND

Increasing the drainage performance of a paper machine is one of the most critical parameters of the papermaking process. The productivity of a paper machine used in the papermaking process is commonly determined by the rate of water drainage from a slurry comprising paper fiber (i.e., the "pulp slurry," "pulp stock", or "furnish") on a forming wire. The rate of water drainage from a pulp slurry is also referred to simply as "drainage performance." As the rate of drainage performance increases, the productivity of a paper mill is increased in terms of both the area and tonnage of paper capable of being produced in a particular timeframe. Improved drainage performance may: (i) allow paper machines to run faster, (ii) decrease the amount of steam needed to remove water at the dry end of the papermaking process, and/or (iii) allow paper having heavier basis weights to be produced.

Recently, there have been various attempts to improve drainage performance for the papermaking process. For example, U.S. Pat. Nos. 4,388,150, 4,753,710, and 5,185,206 describe using the combination of inorganic materials (dubbed "microparticles" or "inorganic microparticles") and high molecular weight water-soluble natural or synthetic-based polymers to provide improved retention and drainage efficacy as compared to conventional high molecular weight water-soluble polymers.

U.S. Pat. Nos. 7,250,448 and 7,396,874 disclose methods of producing and/or using associative polymers to provide improved retention and drainage performance in the papermaking process. These associative polymers can be made by a number of different methods.

U.S. Pat. Nos. 5,167,766, 5,171,808, 5,274,055, 6,310,157, and 7,250,448 disclose methods of producing and/or using branched or cross-linked (co)polymers to provide improved retention and drainage performance in the papermaking process. These branched or crosslinked (co)polymers can be made by a number of different methods.

U.S. Pat. Nos. 6,395,134, 6,391,156, and 6,524,439 disclose an additional increase in retention and drainage performance for papermaking processes by adding a combination of the above-referenced inorganic microparticles and branched or crosslinked polymers to the pulp slurry during the papermaking process.

U.S. Pat. Nos. 6,602,994 and 8,764,939, as well as WO 2013/072550 and WO 2012/098296, disclose the use of various modified cellulosic polymers as drainage aids, optionally, with cationic polymers. In particular, disclosed therein is the use and/or manufacture of microfibrillated carboxymethylcellulose (also referred to as nanofibrillated carboxymethylcellulose) to enhance the drainage performance of a pulp slurry.

However, despite all of the improvements that have been made to the drainage performance of pulp slurries, a need still exists for further improvement in order to increase the overall productivity of the papermaking process. It has been unexpectedly discovered that adding (a) at least one microfibrillated cellulose and (b) at least one associative polymer or at least one branched or crosslinked copolymer to a pulp slurry increases the drainage performance of the pulp slurry, which may lead to an increased productivity for the papermaking process.

DETAILED DESCRIPTION

Before explaining at least one embodiment of the presently disclosed and/or claimed inventive concept(s) in detail, it is to be understood that the presently disclosed and/or claimed inventive concept(s) is not limited in its application to the details of construction and the arrangement of the components or steps or methodologies set forth in the following description or illustrated in the drawings. The presently disclosed and/or claimed inventive concept(s) is capable of other embodiments or of being practiced or carried out in various ways. Also, it is to be understood that the phraseology and terminology employed herein is for the purpose of description and should not be regarded as limiting.

Unless otherwise defined herein, technical terms used in connection with the presently disclosed and/or claimed inventive concept(s) shall have the meanings that are commonly understood by those of ordinary skill in the art. Further, unless otherwise required by context, singular terms shall include pluralities and plural terms shall include the singular.

All patents, published patent applications, and non-patent publications mentioned in the specification are indicative of the level of skill of those skilled in the art to which the presently disclosed and/or claimed inventive concept(s) pertains. All patents, published patent applications, and non-patent publications referenced in any portion of this application are herein expressly incorporated by reference in their entirety to the same extent as if each individual patent or publication was specifically and individually indicated to be incorporated by reference.

All of the articles and/or methods disclosed herein can be made and executed without undue experimentation in light of the present disclosure. While the articles and methods of the presently disclosed and/or claimed inventive concept(s) have been described in terms of preferred embodiments, it will be apparent to those of ordinary skill in the art that variations may be applied to the articles and/or methods and in the steps or in the sequence of steps of the method described herein without departing from the concept, spirit and scope of the presently disclosed and/or claimed inventive concept(s). All such similar substitutes and modifications apparent to those skilled in the art given the presently disclosed and/or claimed inventive concept(s) are deemed to be within the spirit, scope and concept of the presently disclosed and/or claimed inventive concept(s).

As utilized in accordance with the present disclosure, the following terms, unless otherwise indicated, shall be understood to have the following meanings.

The use of the word "a" or "an" when used in conjunction with the term "comprising" may mean "one," but it is also consistent with the meaning of "one or more," "at least one," and "one or more than one." The use of the term "or" is used to mean "and/or" unless explicitly indicated to refer to alternatives only if the alternatives are mutually exclusive, although the disclosure supports a definition that refers to only alternatives and "and/or." Throughout this application, the term "about" is used to indicate that a value includes the inherent variation of error for the quantifying device, the method being employed to determine the value, or the variation that exists among the study subjects. For example, but not by way of limitation, when the term "about" is utilized, the designated value may vary by plus or minus twelve percent, or eleven percent, or ten percent, or nine percent, or eight percent, or seven percent, or six percent, or five percent, or four percent, or three percent, or two percent, or one percent. The use of the term "at least one" will be understood to include one as well as any quantity more than one, including but not limited to, 1, 2, 3, 4, 5, 10, 15, 20, 30, 40, 50, 100, etc. The term "at least one" may extend up to 100 or 1000 or more depending on the term to which it is attached. In addition, the quantities of 100/1000 are not to be considered limiting as lower or higher limits may also produce satisfactory results. In addition, the use of the term "at least one of X, Y, and Z" will be understood to include X alone, Y alone, and Z alone, as well as any combination of X, Y, and Z. The use of ordinal number terminology (i.e., "first", "second", "third", "fourth", etc.) is solely for the purpose of differentiating between two or more items and, unless otherwise stated, is not meant to imply any sequence or order or importance to one item over another or any order of addition.

As used herein, the words "comprising" (and any form of comprising, such as "comprise" and "comprises"), "having" (and any form of having, such as "have" and "has"), "including" (and any form of including, such as "includes" and "include") or "containing" (and any form of containing, such as "contains" and "contain") are inclusive or open-ended and do not exclude additional, unrecited elements or method steps. The term "or combinations thereof" as used herein refers to all permutations and combinations of the listed items preceding the term. For example, "A, B, C, or combinations thereof" is intended to include at least one of: A, B, C, AB, AC, BC, or ABC and, if order is important in a particular context, also BA, CA, CB, CBA, BCA, ACB, BAC, or CAB. Continuing with this example, expressly included are combinations that contain repeats of one or more items or terms, such as BB, AAA, AAB, BBC, AAABCCCC, CBBAAA, CABABB, and so forth. The skilled artisan will understand that typically there is no limit on the number of items or terms in any combination, unless otherwise apparent from the context.

As used herein, the term "substantially" means that the subsequently described event or circumstance completely occurs or that the subsequently described event or circumstance occurs to a great extent or degree. For example, when associated with a particular event or circumstance, the term "substantially" means that the subsequently described event or circumstance occurs at least 80% of the time, or at least 85% of the time, or at least 90% of the time, or at least 95% of the time.

Although the term "microfibrillated cellulose" is known to persons of ordinary skill in the art and has been well-described in literature, for purposes of the presently disclosed and/or claimed inventive concept(s), microfibrillated cellulose is defined as cellulose consisting of microfibrils in the form of either isolated cellulose microfibrils and/or microfibril bundles of cellulose, both of which are derived from a cellulose raw material.

The aspect ratio of microfibrils is typically high and the length of individual microfibrils may be more than one micrometer and the diameter may be within a range of about 5 to 60 nm with a number-average diameter typically less than 20 nm. The diameter of microfibril bundles may be larger than 1 micron, however, it is usually less than one.

In one non-limiting example, the microfibrillated cellulose may at least partially comprise nanocellulose. The nanocellulose may comprise mainly nano-sized fibrils having a diameter that is less than 100 nm and a length that may be in the micron-range or lower. The smallest microfibrils are similar to the so-called elemental fibrils, the diameter of which is typically 2 to 4 nm. Of course, the dimensions and structures of microfibrils and microfibril bundles depend on the raw materials used in addition to the methods of producing the microfibrillated cellulose. Nonetheless, it is expected that a person of ordinary skill in the art would understand the meaning of "microfibrillated cellulose" in the context of the presently disclosed and/or claimed inventive concept(s).

As used herein, "microfibrillated cellulose" can be used interchangeably with "microfibrillar cellulose," "nanofibrillated cellulose," "nanofibril cellulose," "nanofibers of cellulose," "nanoscale fibrillated cellulose," "microfibrils of cellulose," and/or simply as "MFC." Additionally, as used herein, the terms listed above that are interchangeable with "microfibrillated cellulose" may refer to cellulose that has been completely microfibrillated or cellulose that has been substantially microfibrillated but still contains an amount of non-microfibrillated cellulose at levels that do not interfere with the benefits of the microfibrillated cellulose as described and/or claimed herein.

As used herein, the term "copolymer" is defined as a polymer composition comprising two or more different monomeric units.

As used herein, the terms "associative polymer" or "associative copolymer" are defined as one or more polymers provided by an effective amount of at least one emulsification surfactant chosen from diblock and triblock polymeric surfactants, wherein the diblock or triblock surfactant to monomer ratio is at least about 0.03 and the pH is adjusted to from about 2 to about 7 and wherein no additional crossing linking agent is added to the system, and wherein said associative polymer has a Huggins' constant (k') determined in 0.01 M NaCl greater than 0.75; and has a storage modulus (G') in a 1.5 wt. % actives polymer solution at 4.6 Hz greater than 175 Pa.

The phrase "branched or crosslinked copolymer," as used herein, is directed to one or more copolymers comprising at least one nonionic monomer, at least one ionic monomer, and a branching or crosslinking agent.

The terms "active" and "active solids" as used herein are defined as the non-volatile weight percentage of a composition (e.g., an additive, a reactant and/or a product) that is functional. Typically, the active solids, or simply "actives", are indicated by a manufacturer of a composition. The active solids contents for the materials in the examples described herein (e.g., for the microfibrillated cellulose, associative polymer, and/or branched or crosslinked copolymer) are provided where necessary. In particular, the active solids content for the microfibrillated cellulose is the amount of dry cellulose that is subsequently subjected to shear when forming the microfibrillated cellulose using the well-known homogenization method. Additionally, the active solids content for the associative polymer or the branched or crosslinked copolymer is the amount of polymerized polymer in a composition or final product. However, the active solids content for the associative polymer(s) or the branched or crosslinked copolymer does not correspond to the overall amount of non-volatile material in a composition or final product due to, for example, surfactants also being present in the composition or final product.

Turning now to the presently disclosed and/or claimed inventive concept(s), certain embodiments thereof are directed to a method of manufacturing paper products, wherein the method has been found to unexpectedly increase the drainage performance of a pulp slurry during the papermaking process. Certain other embodiments of the presently disclosed and/or claimed inventive concept(s) are directed to one or more paper products that have been produced by the presently disclosed and/or claimed method.

In one embodiment, the presently disclosed and/or claimed inventive concept(s) is directed to a method of manufacturing paper products comprising adding (a) at least one microfibrillated cellulose and (b) at least one associative polymer or at least one branched or crosslinked copolymer to a pulp slurry. The paper products may be selected from the group consisting of paper, paperboard, and/or cardboard. The paper products may also be any other paper product produced according to the disclosed and/or claimed method(s) as determined by a person of ordinary skill in the art.

The pulp slurry may comprise pulp obtained from a variety of sources including, for example but without limitation, wood-based materials, plant-based materials, and/or recycled paper products. In one embodiment, the pulp slurry comprises pulp obtained from wood sources. The pulp slurry may comprise pulp obtained using at least one of a mechanical process, thermo-mechanical process, chemical-thermal mechanical process, and/or a chemical process. The chemical process may include, for example but without limitation, the kraft process and/or the sulfite process.

Microfibrillated Cellulose

The at least one microfibrillated cellulose may be formed from one or more cellulose-containing raw materials including, for example but without limitation, (a) wood-based raw materials like hardwoods and/or softwoods, (b) plant-based raw materials like agricultural residue, grasses, straw, bark, caryopses, vegetables, cotton, maize, wheat, oat, rye, barley, rice, flax, hemp, abaca, sisal, kenaf, jute, ramie, bagasse, bamboo, reed, algae, fungi and/or combinations thereof, and/or (c) recycled fibers from, for example but without limitation, newspapers and/or other paper products.

In one embodiment, the at least one microfibrillated cellulose is produced from cotton linters. Cotton linters generally contain a higher purity of cellulose and have a higher molecular weight of cellulose in their fibers. In another embodiment, the at least one microfibrillated cellulose is produced from wood pulp. The wood pulp may be produced by a mechanical and/or chemical process. In one embodiment, the wood pulp is produced by the kraft pulping process such that at least a portion of the lignin and other impurities originating from the source of the wood pulp are removed.

In one embodiment, the wood pulp used to produce the at least one microfibrillated cellulose is from a softwood tree. Generally, the fibers of softwood trees have a higher molecular weight than the fibers of hardwood trees and/or recycled paper products.

The at least one microfibrillated cellulose may be produced by any method of reducing the particle size of polysaccharides as would be known to a person of ordinary skill in the art. However, methods for reducing particle size while preserving a high aspect ratio in the polysaccharide are preferred. In particular, the at least one microfibrillated cellulose may be produced by a method selected from the group consisting of grinding; sonication; homogenization; impingement mixer; heat; steam explosion; pressurization-depressurization cycle; freeze-thaw cycle; impact; grinding (such as a disc grinder); pumping; mixing; ultrasound; microwave explosion; and/or milling. Various combinations of these may also be used, such as milling followed by homogenization. In one embodiment, the at least one microfibrillated cellulose is formed by subjecting one or more cellulose-containing raw materials to a sufficient amount of shear in an aqueous suspension such that a portion of the crystalline regions of the cellulose fibers in the one or more cellulose-containing raw materials are fibrillated.

In one embodiment, the at least one microfibrillated cellulose may be produced by any of the above-recited methods in the presence of one or more of the associative polymers described later herein. Alternatively and/or additionally, the at least one microfibrillated cellulose may be produced by any of the above-recited methods prior to blending with one or more of the associative polymers described later herein.

The microfibrillated cellulose may be in the form of at least one of a dispersion (e.g., in a gel or gelatinous form), a diluted dispersion, and/or in a suspension.

Derivatized Microfibrillated Cellulose

In one embodiment, the microfibrillated cellulose may be a derivatized microfibrillated cellulose, wherein the microfibrillated cellulose fibers of the derivatized microfibrillated cellulose have an anionic and/or cationic charge. The derivatized microfibrillated cellulose may be produced by (a) derivatizing a microfibrillated cellulose and/or (b) fibrillating a cellulose that has already been derivatized. In another embodiment, the cellulose of one or more cellulose-containing raw materials can be fibrillated and derivatized at substantially the same time.

The degree of functionalization of the derivatized cellulose (or derivatized microfibrillated cellulose) is referred to as the degree of substitution, or "DS", which is the average number of functionalizations per β-anhydroglucose unit of a cellulose chain. In other words, the degree of functionalization, as used herein, is the amount of anionic and/or cationic substituents present on the cellulose and the degree of substitution is the average number of anionic and/or cationic substituents on the per β-anhydroglucose unit of a cellulose chain. The methods of determining the DS of a derivatized cellulose and/or derivatized microfibrillated cellulose are disclosed in U.S. Pat. No. 6,602,992, which is hereby incorporated by reference herein in its entirety.

The DS of the derivatized cellulose may be in the range of from about 0.02 to 0.5, or from about 0.03 to about 0.4, or from about 0.05 to about 0.35, or from about 0.1 to about 0.35, or from about 0.1 to about 0.25. Without intending to be bound to a particular theory, it is predicted that (i) a DS value below this range provides insufficient density of functionalization to enhance the susceptibility of the cellulose to shear during fibrillation, and (ii) a DS value above this range renders the cellulose mostly or entirely water soluble, thereby preventing the formation of a dispersion.

Any suitable process may be used to place the substituents on the cellulose. As used herein, a "derivatization process" refers to the general process whereby the cellulose (or microfibrillated cellulose) is modified to have anionic and/or cationic substituents thereon such that a DS in the range of from about 0.02 to 0.5, or from about 0.03 to about 0.4, or from about 0.05 to about 0.35, or from about 0.1 to about 0.35, or from about 0.1 to about 0.25 is achieved. The derivatization process may be due to (i) a chemical reaction resulting in the formation of covalent bonding between the cellulose and the anionic and/or cationic substituent, and/or (ii) physical adsorption.

In one non-limiting embodiment, the cellulose of the one or more cellulose-containing raw materials may be derivatized to give the cellulose fibers an overall charge prior to fibrillating the cellulose fibers so as to produce an anionic and/or cationic microfibrillated cellulose. Without intending to be bound to a particular theory, it is predicted that derivatized cellulose having either an anionic or cationic charge (i) requires less energy to shear and is thereby more susceptible to microfibrillation, and/or (ii) generates an electrostatic repulsion between similarly charged moieties on a given cellulose fiber creating disruptions in the crystallinity in portions of the fiber, thereby encouraging microfibrillation of the cellulose fibers.

In one embodiment, the cellulose is treated with a base prior to the addition of one or more derivatizing reagents. In one non-limiting example, the base may be sodium hydroxide. Without intending to be bound to a particular theory, it is predicted that treatment of the cellulose with a base causes the fiber bundles in the cellulose to swell, which in turn exposes parts of the cellulose fibers that can be functionalized. The time, temperature, and amount of base are all factors that can affect the functionalization and subsequent susceptibility of the cellulose to shear to form derivatized microfibrillated cellulose.

In one embodiment, a cationic charge for the cellulose may be obtained (i.e., one or more cationic substituents may be added to the cellulose) by treating the cellulose with at least one reactive cationic derivatizing reagent. The cationic derivatizing reagent may include, for example but without limitation, 2-dimethylamino ethyl chloride, 2-diethylamino ethyl chloride, 3-dimethylamino propyl chloride, 3-diethylamino propyl chloride, 3-chloro-2-hydroxypropyl trimethylammonium chloride, and combinations thereof. In one embodiment, the cationic derivatizing reagent is 3-chloro-2-hydroxypropyl trimethylammonium chloride.

In one embodiment, an anionic charge for the cellulose may be obtained (i.e., one or more anionic substituents may be added to the cellulose) by directly oxidizing the cellulose with an oxidizing agent. The oxidation generally takes place at the C-6 position of the β-anhydroglucose unit of cellulose. In one embodiment, the oxidizing agent may be soluble in water or in one or more organic solvents.

The oxidizing agent can be one or more N-oxides. The N-oxide can be, for example but without limitation, (2,2,6,6-Tetramethylpiperidin-1-yl)oxyl, otherwise referred to simply as "TEMPO."

In another embodiment, an anionic charge for the cellulose may be obtained by the reaction of a cellulose suspension with one or more anionic derivatizing reagents including, for example but without limitation, chloroacetic acid, dichloroacetic acid, bromoacetic acid, dibromoacetic acid, salts thereof, and/or combinations thereof. In one embodiment, the anionic derivatizing reagent is chloroacetic acid. In one embodiment, the derivatized cellulose is carboxymethyl cellulose. An example of a method for producing carboxymethyl cellulose is disclosed in U.S. Pat. No. 6,602,994, previously incorporated herein by reference in its entirety.

The total amount of active solids of any one of the embodiments of the microfibrillated cellulose described above may be added to the pulp slurry in the range of from about 0.2 to about 20 lbs. of active solids per ton of dry pulp, or from about 0.3 to about 15 lbs. of active solids per ton of dry pulp, or from about 0.4 to about 10 lbs. of active solids per ton of dry pulp, or from about 0.5 to about 5 lbs. of active solids per ton of dry pulp.

Associative Polymer

The associative polymer(s) may be a water-soluble copolymer represented by Formula I below:

$$-[\text{B-co-F}]- \qquad \text{(Formula I)}$$

Referring to Formula I, B is a nonionic polymer segment formed from the polymerization of one or more ethylenically unsaturated nonionic monomers; F is an anionic polymer segment, cationic polymer segment, or combination of anionic and cationic polymer segments formed from the polymerization of one or more ethylenically unsaturated anionic and/or cationic monomers; and "co" is a designation for a polymer system with an unspecified arrangement of two or more monomer components. It is also to be understood that more than one kind of nonionic monomer, anionic monomer, and/or cationic monomer may be present in Formula I.

The ethylenically unsaturated nonionic monomers forming the polymer segment B in Formula I can be, for example but without limitation, acrylamide; methacrylamide; N-alkylacrylamides, such as N-methylacrylamide; N,N-dialkylacrylamide, such as N,N-dimethylacrylamide; methyl acrylate; methyl methacrylate; acrylonitrile; N-vinyl methylacetamide; N-vinyl fromamide; N-vinyl methyl formamide; vinyl acetate; N-vinyl methyl formamide; vinyl acetate; N-vinyl pyrrolidone; hydroxyalky(meth)acrylates such as hydroxyethyl(meth)acrylate and/or hydroxypropyl(meth)acrylate; and/or any combinations thereof.

In one embodiment, the nonionic polymer segment B in Formula I can alternatively, or additionally, comprise one or more nonionic monomers having a more hydrophobic nature, wherein "more hydrophobic" is used to indicate nonionic monomers having a reduced solubility in aqueous solutions. In one non-limiting example, the "more hydrophobic" nonionic monomers may have such a reduced solubility in aqueous solutions that the nonionic monomers are insoluble in water. These "more hydrophobic" nonionic monomers are also referred to as "polymerizable surfactants" and/or "surfmers", as would be recognized by persons of ordinary skill in the art.

The polymerizable surfactants (or "surfmers") may include, for example but without limitation, alkylacrylamides and/or ethylenically unsaturated monomers having at least one of (a) a pendant aromatic group and/or an alkyl group, and/or (b) an ether represented by the formula $CH_2{=}CR'CH_2OA_mR$, where (i) R' is hydrogen or a methyl group, (ii) A is a polymer comprising one or more polyethers such as, for example but without limitation, ethylene oxide, propylene oxide, and/or butylene oxide, (iii) m is the polyether degree of polymerization, and (iv) R may be, for example but without limitation, a hydrophobic group selected from the group consisting of vinylalkoxylates, allyl alkoxylates, allyl phenyl polyol ether sulfates, and/or combinations thereof. In one non-limiting example, the polymerizable surfactant may be at least one of methylmethacrylate, styrene, t-octyl acrylamide, and/or an allyl phenyl polyol ether sulfate commercially available as Emulsogen® APG 2019 from Clariant (Frankfurt, Germany).

In one embodiment, F in Formula I is an anionic polymer segment formed from the polymerization of one or more ethylenically unsaturated anionic monomers. The anionic monomers may include, for example but without limitation, the free acids and salts of: acrylic acid; methacrylic acid; maleic acid; itaconic acid; acrylamidoglycolic acid; 2-acrylamido-2-methyl-1-propanesulfonic acid; 3-allyloxy-2-hydroxy-1-propanesulfonic acid; styrenesulfonic acid; vinylsulfonic acid; vinylphosphonic acid; 2-acrylamido-2-methylpropane phosphonic acid, and/or combinations thereof.

In one embodiment, F in Formula I is a cationic polymer segment formed from the polymerization of one or more ethylenically unsaturated cationic monomers. The cationic monomers may include, for example but without limitation, the free base or salt of: diallyldialkylammonium halides, such as diallyldimethylammonium chloride; (meth)acrylates of dialkylaminoalkyl compounds, such as, for example, dimethylaminoethyl (meth)acrylate, dimethylaminoethyl (meth)acrylate, dimethyl aminopropyl (meth)acrylate, 2-hydroxydimethyl aminopropyl (meth)acrylate, aminoethyl (meth)acrylate, and/or the salts and quaternaries thereof; N,N-dialkylaminoalkyl(meth)acrylamides, such as N,N-dimethylaminoethylacrylamide, and/or the salts and quaternaries thereof; and/or combinations thereof.

Depending on the composition of F, the associative polymer can be a nonionic, cationic, anionic, or amphoteric (containing both cationic and anionic charges) water-soluble copolymers.

In one embodiment, the associative polymer may be an anionic copolymer, wherein B is a nonionic polymer segment as defined in any one of the relevant embodiments above and F is an anionic polymer segment as defined above. The molar ratio of nonionic monomer to anionic monomer (i.e., B:F) may be in the range of from about 95:5 to about 5:95, or from about 75:25 to about 25:75, or from about 65:35 to about 35:65, or from about 60:40 to about 40:60. In this regard, the molar percentages of B and F must add up to 100%. It is to be understood that more than one kind of nonionic monomer and/or anionic monomer may be present in their respective segments, B and F.

The physical characteristics of the anionic copolymers are unique in that (i) their Huggins' constant (k') determined between 0.0025 wt % to 0.025 wt % in 0.01M NaCl is greater than 0.75, or greater than 0.9, or greater than 1.0, and (ii) the storage modulus (G') for a 1.5 wt % actives polymer solution at 4.6 Hz is greater than 175 Pa, or greater than 190 Pa, or greater than 195 Pa, or greater than 205 Pa.

In one embodiment, the associative polymer is an anionic copolymer, wherein the nonionic polymer segment, B, comprises polymerized monomers of acrylamide and the anionic polymer segment, F, comprises polymerized salts (or free acids) of acrylic acid, and the molar percent ratio of the nonionic polymer segment to the anionic polymer segment (B:F) is from about 75:25 to about 25:75.

In another embodiment, the associative polymer may be a cationic copolymer, wherein B is a nonionic polymer segment as described in any one of the relevant embodiments above and F is a cationic polymer segment as described above. The molar ratio of nonionic monomer to cationic monomer (i.e., B:F) may be in the range of from about 99:1 to 50:50, or from about 95:5 to 50:50, or from about 95:5 to about 75:25, or from about 90:10 to about 65:35, or from about 85:15 to about 60:40, or from about 80:20 to about 50:50. In this regard, the molar percentages of B and F must add up to 100%. It is to be understood that more than one kind of nonionic monomer and/or cationic monomer may be present in their respective segments, B and F.

In yet another embodiment, the associative polymer may be an amphoteric copolymer, wherein B is a nonionic polymer segment as described in any one of the relevant embodiments above and F is a combination of anionic and cationic polymer segments formed from the polymerization of one or more ethylenically unsaturated anionic and cationic monomers, as individually described above. The minimum amount of each of the anionic, cationic, and nonionic monomer in the amphoteric copolymer is 1% of the total amount of monomer used to form the amphoteric copolymer. The maximum amount of the nonionic, anionic, or cationic monomer is 98% of the total amount of monomer used to form the amphoteric copolymer. In one embodiment, the minimum amount of any of the anionic, cationic and nonionic monomers is 5%, or 7%, or 10% of the total amount of monomer used to form the amphoteric copolymer. In this regard, the molar percentages of the anionic, cationic and nonionic monomers must add up to 100%. It is to be understood that more than one kind of nonionic monomer, anionic monomer, and/or cationic monomer may be present in their respective segments, B and F.

The physical characteristics of the cationic and amphoteric copolymers are unique in that (i) their Huggins' constant (k') determined between 0.0025 wt % to 0.025 wt % of the copolymer in 0.01 M NaCl is greater than 0.5, or greater than 0.6, or greater than 0.9, or greater than 1.0, and (ii) the storage modulus (G') for a 1.5 wt. % actives polymer solution at 6.3 Hz is greater than 10 Pa, or greater than 25 Pa, or greater than 50 Pa, or greater than 100 Pa, or greater than 175 Pa, or greater than 200 Pa.

In one aspect of the presently disclosed and/or claimed inventive concept(s), the water-soluble copolymer(s) making up the associative polymer, as represented by Formula I, may be prepared by an inverse (water-in-oil) emulsion polymerization technique. Such a technique is known to those of ordinary skill in the art, as described in, for example, U.S. Pat. No. 3,284,393, and Reissue U.S. Pat. Nos. 28,474 and 28,576, each of which is hereby incorporated by reference in its entirety.

The inverse (water-in-oil) emulsion polymerization process generally comprises: (1) preparing an aqueous solution of one or more ethylenically unsaturated nonionic, cationic, and/or anionic monomers (non-limiting examples of which are described above), (2) contacting the aqueous solution with a hydrocarbon liquid containing an appropriate emulsification surfactant or mixture of emulsification surfactants to form an inverse monomer emulsion, (3) subjecting the inverse monomer emulsion to free radical polymerization, and, optionally, (4) adding one or more breaker surfactants to enhance the inversion of the emulsion when added to water.

Polymerization of the emulsion may be carried out in any manner known to those skilled in the art. Initiation may be effected with a variety of thermal initiators including azo compounds such as azobisisobutyronitrile, organic peroxides such as dilauryl peroxide, and the like. Polymerization may also be affected by "redox", or reduction-oxidation pairs. The oxidizers can include, for example but without limitation, peroxides such as dilauryl peroxide, cumene hydroperoxide, dicumyl peroxide and/or hydrogen peroxide, and the reducing agents can include, for example but without limitation, sodium metabisulfite and/or transition metals such as copper sulfate. Polymerization may also be effected by photochemical irradiation processes, irradiation, or by ionizing radiation with a $^{60}$Co source.

Preferred initiators are oil soluble thermal initiators. Typical non-limiting examples include 2,2'-azobis-(2,4-dimethylpentanenitrile); 2,2'-azobisisobutyronitrile (AIBN); 2,2'-azobis-(2,-methylbutanenitrile); 1,1'-azobis (cyclohexanecarbonitrile); benzoyl peroxide and dilauryl peroxide.

Any of the chain transfer agents known to those skilled in the art may be used to control the molecular weight. Those include, for example but without limitation, lower alkyl alcohols such as isopropanol, amines, mercaptans such as mercaptoethanol, phosphites, thioacids, allyl alcohol, and the like.

The aqueous phase may also comprise conventional additives as desired. For example, the mixture may contain chelating agents, pH adjusters, initiators, chain transfer agents as described above, and/or other conventional additives. For the preparation of the water-soluble copolymers, the pH of the aqueous solution is in the range of from 2 to 7, or 3 to 7, or 4 to 6.

The hydrocarbon liquid may comprise straight-chain hydrocarbons, branched-chain hydrocarbons, saturated cyclic hydrocarbons, aromatic hydrocarbons, and/or combinations thereof.

The emulsification surfactant or mixture of emulsification surfactants used to form the inverse emulsion impact the resultant associative polymer. The emulsion surfactants used in the inverse (water-in-oil) emulsion polymerization process are generally known to those skilled in the art. Such surfactants typically have a range of Hydrophilic Lipophilic Balance (HLB) values that is dependent on the overall composition. The choice and amount of the emulsification surfactant(s) are selected in order to yield an inverse monomer emulsion for polymerization. One or more of the emulsion surfactants are selected in order to obtain a specific HLB value.

In one embodiment, the emulsification surfactant or mixture of emulsification surfactants may comprise at least one diblock and/or triblock polymeric surfactant—also referred to herein as the "primary emulsification surfactant(s)." Diblock and triblock polymeric emulsification surfactants, when used in requisite quantities, result in distinct polymers and/or copolymers having unique characteristics, as disclosed in, for example, WO 03/050152 and U.S. Pat. Nos. 7,250,448 and 7,396,874, each of which is incorporated by reference herein in its entirety.

The diblock and triblock polymeric surfactants can include, for example but without limitation: diblock and triblock copolymers based on polyester derivatives of fatty acids and poly[ethyleneoxide], such as Hypermer® B246SF available from Croda (New Castle, Del.); diblock and triblock copolymers based on polyisobutylene succinic anhydride and poly[ethyleneoxide]; reaction products of ethylene oxide and propylene oxide with ethylenediamine; and/or combinations thereof.

In one embodiment, the diblock and triblock polymeric surfactants are based on polyester derivatives of fatty acids and poly[ethyleneoxide]. In another embodiment, the emulsification surfactant comprises at least one triblock polymeric surfactant, wherein the at least one triblock polymeric surfactant comprises two hydrophobic regions and one hydrophilic region—i.e., the triblock polymeric surfactant comprises a "hydrophobe-hydrophile-hydrophobe" structure.

The amount of diblock and/or triblock polymeric surfactant used is dependent on the amount of the monomers used to form the associative polymer (based on weight percent). The ratio of diblock and/or triblock polymeric surfactant to the monomers is from about 3 to 100, or from about 4 to 100, or from about 5 to 100, or from about 6 to about 100.

In one embodiment, one or more additional emulsification surfactants, referred to herein as "secondary emulsification surfactants," can be added along with the previously described "primary emulsification surfactants." The "secondary emulsion surfactants" can include, for example but without limitation: sorbitan fatty acid esters, such as sorbitan monooleate commercially available from Croda (New Castle, Del.) under the brand name Atlas™ G-946; ethoxylated sorbitan fatty acid esters; polyethoxylated sorbitan fatty acid esters; ethylene oxide and/or propylene oxide adducts of alkylphenols; ethylene oxide and/or propylene oxide adducts of long chain alcohols or fatty acids; mixed ethylene oxide/propylene oxide block copolymers; alkanolamides; sulfosuccinates; and combinations thereof. The ratio of secondary emulsification surfactants to the monomers (based on weight percent) is from about 3 to about 100, or from about 4 to about 100, or from about 5 to about 100, or from about 6 to about 100.

The breaker surfactants are additional surfactants that can be added to an emulsion to promote inversion. The breaker surfactants can include, for example but without limitation, ethylene oxide (EO)/propylene oxide (PO) diblock (AB) and triblock (ABA or BAB) copolymers, ethoxylated alcohols, alcohol ethoxylates, ethoxylated esters of sorbitan, ethoxylated esters of fatty acids, ethoxylated fatty acid esters and ethoxylated esters of sorbitol and fatty acids, and combinations thereof.

Polymerization of the inverse emulsion may be carried out in any manner known to those skilled in the art. Examples of such can be found in many references, including, for example but without limitation, Allcock and Lampe, Contemporary Polymer Chemistry, (Englewood Cliffs, N.J., PRENTICE-HALL, 1981), chapters 3-5.

The associative polymer may be provided to the pulp slurry in a number of physical forms including: the original emulsion form produced by the above-described inverse (water-in-oil) emulsion polymerization process, as an aqueous solution, dry solid powder, and/or in dispersion form. In one embodiment, the associative polymer or associative polymer emulsion is diluted to produce a dilute solution of the associative polymer comprising an aqueous solution of 0.1 to 1 wt % active associative polymer.

The associative polymer may be added to the pulp slurry at any amount that is effective in achieving flocculation. In one embodiment, the amount of the associative polymer(s), as described above, may be added to the pulp slurry at an amount greater than 0.05 lbs. of active associative polymer(s) per ton of dry pulp, or from about 0.02 to about 2 lbs.

of active associative polymer(s) per ton of dry pulp, or from about 0.05 to about 1 lbs of active associative polymer per ton of dried pulp.

Branched or Crosslinked Copolymer

The branched or crosslinked copolymer may be one or more copolymers of at least one nonionic monomer, at least one ionic monomer, and at least one branching or crosslinking agent. Further, the ionic monomer(s) may be at least one of an anionic monomer and/or a cationic monomer. Use of both anionic and cationic monomers in the same branched or crosslinked copolymer results in an amphoteric material. The branched or crosslinked copolymers are typically formed by the polymerization of ethylenically unsaturated monomers that can be anionic, cationic, and/or nonionic. Inverse emulsion polymerization is typically used to prepare these materials although other polymerization methods known to those skilled in the art can be used.

The ethylenically unsaturated nonionic monomer(s) used in preparing the branched or crosslinked copolymer(s) include, for example but without limitation, acrylamide; methacrylamide; N,N-dialkylacrylamides; N-alkylacrylamides; N-vinyl methacetamide; N-vinyl methylformamide; N-vinyl pyrrolidone; and/or combinations thereof.

The anionic monomer(s) used in preparing the branched or crosslinked copolymer(s) include, for example but without limitation, acrylic acid, methacrylic acid, 2-acrylamido-2-alkylsulfonic acids where the alkyl group contains 1 to 6 carbon atoms, such as 2-acrylamido-2-propane-sulfonic acid; and their alkaline salts; and/or combinations thereof. In one embodiment, the anionic monomer(s) can be the salts or acids of acrylic acid, methacrylic acid, 2-acrylamido-2-methylpropane sulfonic acid, and/or combinations thereof. The anionic monomer(s) comprising salts may have sodium as the cation.

The cationic monomer(s) used in preparing the branched or crosslinked copolymer(s) include, for example but without limitation, the free base or salts of: acryloxyethyltrimethylammonium chloride; diallydimethylammonium chloride; 3-(meth)acrylamido-propyltrimethylammonium chloride; 3-acrylamido-propyltrimethylammonium-2-hydroxypropylacrylate methosulfate; trimethylammonium-ethyl methacrylate methosulfate; 1-trimethylammonium-2-hydroxypropyl-methacrylate methosulfate; methacryloxyethyltri-methylammonium chloride; and/or combinations thereof.

These ethylenically unsaturated anionic, cationic, and nonionic monomers making up the branched or crosslinked copolymer(s) may be polymerized to form anionic, cationic and/or amphoteric copolymers, with the three types of monomer present in any ratio. In one embodiment, acrylamide is the nonionic monomer.

Polymerization of the monomers to form the branched or crosslinked copolymer(s) may be conducted in the presence of at least one polyfunctional crosslinking agent to form the crosslinked composition. The polyfunctional crosslinking agent comprises molecules that have at least two double bonds, or a double bond and reactive group, or two reactive groups. Polyfunctional crosslinking agents containing at least two double bonds include, for example but without limitation, N,N-methylenebisacrylamide, N,N-methylenebismethacrylamide, polyethyleneglycol diacrylate, polyethyleneglycol dimethacrylate, N-vinyl acrylamide, divinylbenzene, triallylammonium salts, N-methyallylacrylamide, and/or combinations thereof. Polyfunctional crosslinking or branching agents containing at least one double bond and at least one reactive group include, for example but without limitation, glycidyl acrylate, acrolein, methylolacrylamide, and/or combinations thereof. Polyfunctional branching agents containing at least two reactive groups include, for example but without limitation, aldehydes such as glyoxal, diepoxy compounds, epichlorohydrin, and/or combinations thereof. Crosslinking agents are used in sufficient quantities to assure a crosslinked composition. Non-limiting examples of the branched or crosslinked copolymer(s) are disclosed in U.S. Pat. Nos. 5,171,808 and 5,167,766.

Method of Adding Microfibrillated Cellulose(s) and Associative Polymer(s) to a Pulp Slurry In one embodiment, the above-described microfibrillated cellulose(s) and associative polymer(s) may be added to a pulp slurry prior to and/or while in the wet end of a paper machine to increase the drainage performance of the pulp slurry during the papermaking process. In one particular embodiment, the above-described microfibrillated cellulose(s) and associative polymer(s) are added to the pulp slurry before the dewatering step whereby the pulp slurry is formed into a fibrous mat. Generally, retention and drainage aids are added to the pulp slurry close to the forming section of a paper machine where the pulp slurry (also referred to as "pulp stock") is at its most dilute level, known as "thin stock."

The microfibrillated cellulose(s) and/or associative polymer(s) may be added at one feed point, or may be split fed such that the microfibrillated cellulose(s) and/or associative polymer are fed simultaneously to two or more separate feed points. Typical addition points to the pulp slurry include feed point(s) before the fan pump, after the fan pump, before the pressure screen, and/or after the pressure screen.

The microfibrillated cellulose(s) and the one or more associative polymers can be added to the pulp slurry at the same and/or different points on the paper machine. In the case that they are added to the pulp slurry separately, the microfibrillated cellulose(s) can be added before and/or after the one or more associative polymers. In the case that they are added to the pulp slurry at the same point on the paper machine, the microfibrillated cellulose(s) can be produced by any of the above-described embodiments before blending with one or more of the associative polymers. Alternatively and/or additionally, the microfibrillated cellulose(s) can be produced by any one of the above-described embodiments in the presence of one or more of the above-described associative polymers prior to adding both the microfibrillated cellulose(s) and associative polymer(s) to the pulp slurry.

The microfibrillated cellulose(s) and associative polymer(s) can be added to the pulp slurry in a ratio of microfibrillated cellulose(s) to associative polymer(s) in the range of from about 1:10 to about 10:1, or from about 1:5 to about 5:1, or from about 1:5 to about 2:1 on an active solids basis of the microfibrillated cellulose(s) to associative polymer(s).

The total amount of active solids of both the microfibrillated cellulose(s) and associative polymer(s) added to the paper machine is in the range of from 0.2 to 20 lbs. of active solids per ton of dry pulp, or from about 0.3 to about 15 lbs. of active solids per ton of dry pulp, or from about 0.4 to about 10 lbs. of active solids per ton of dry pulp, or from about 0.5 to 5 lbs. of active solids per ton of dry pulp.

In one embodiment, the microfibrillated cellulose(s) and associative polymer(s) are added to the pulp slurry in a ratio of from about 10:1 to about 1:10. The total amount of the active solids of the microfibrillated cellulose(s) and associative polymer(s) may be added in the range of from about 0.01 to about 0.50 wt % based on the weight of dry pulp.

In one embodiment, the microfibrillated cellulose(s) and associative polymer(s) are added to the pulp slurry in a ratio of from about 5:1 to about 2:1. The total amount of the active solids of the microfibrillated cellulose(s) and associative polymer(s) may be added in the range of from about 0.01 to about 0.15 wt % based on the weight of dry pulp.

In yet another embodiment, it is feasible that the above-described microfibrillated cellulose(s) and associative polymer(s) may be added to the pulp slurry in the paper machine at a point wherein the pulp slurry is a thick stock.

The presently disclosed and/or claimed inventive concept(s) is sensitive to varying pulp furnish type and quality. One skilled in the art knows that a typical furnish for alkaline free sheet used for printing and writing applications usually possesses relatively little anionic charge when compared to recycled furnish used for a packaging paper product. The alkaline free sheet furnish contains fibers with few contaminants such as, for example but without limitation, anionic trash, lignin, and/or stickies, which commonly possess an anionic charge, while the recycled furnish usually contains significant amounts of these same contaminants. Therefore, a recycled furnish can accommodate greater amounts of cationic additives to enhance the performance of the papermaking process and the paper product itself relative to the alkaline free sheet furnish. Thus, the most useful embodiment(s) of this invention may depend on such critical factors of papermaking such as furnish quality and final product.

Method of Adding Microfibrillated Cellulose(s) and Branched or Crosslinked Copolymer(s) to a Pulp Slurry In one embodiment, the above-described microfibrillated cellulose(s) and branched or crosslinked copolymer(s) may be added to a pulp slurry prior to and/or while in the wet end of a paper machine to increase the drainage performance of the pulp slurry during the papermaking process. In one particular embodiment, the above-described microfibrillated cellulose(s) and branched or crosslinked copolymer(s) are added to the pulp slurry before the dewatering step whereby the pulp slurry is formed into a fibrous mat. Generally, retention and drainage aids are added to the pulp slurry close to the forming section of a paper machine where the pulp slurry (also referred to as "pulp stock") is at its most dilute level, known as "thin stock."

The microfibrillated cellulose(s) and/or branched or crosslinked copolymer(s) may be added at one feed point, or may be split fed such that the microfibrillated cellulose(s) and/or branched or crosslinked copolymer(s) are fed simultaneously to two or more separate feed points. Typical addition points to the pulp slurry include feed point(s) before the fan pump, after the fan pump, before the pressure screen, and/or after the pressure screen.

The microfibrillated cellulose(s) and branched or crosslinked copolymer(s) can be added to the pulp slurry at the same and/or different points on the paper machine. In the case that they are added to the pulp slurry separately, the microfibrillated cellulose(s) can be added before and/or after the one or more branched or crosslinked copolymer(s). In the case that they are added to the pulp slurry at the same point on the paper machine, the microfibrillated cellulose(s) can be produced by any of the above-described embodiments before blending with one or more of the branched or crosslinked copolymers. Alternatively and/or additionally, the microfibrillated cellulose(s) can be produced by any one of the above-described embodiments in the presence of one or more of the above-described branched or crosslinked copolymer(s) prior to adding both the microfibrillated cellulose and branched or crosslinked copolymer(s) to the pulp slurry.

The microfibrillated cellulose(s) and branched or crosslinked copolymer(s) can be added to the pulp slurry in a ratio of microfibrillated cellulose(s) to branched or crosslinked copolymer(s) in the range of from about 1:10 to about 10:1, or from about 1:5 to about 5:1, or from about 1:5 to about 2:1 on an active solids basis of the microfibrillated cellulose(s) to the branched or crosslinked copolymer(s).

The total amount of active solids of both the microfibrillated cellulose(s) and the branched or crosslinked copolymer(s) added to the paper machine is in the range of from 0.2 to 20 lbs. of active solids per ton of dry pulp, or from about 0.3 to about 15 lbs. of active solids per ton of dry pulp, or from about 0.4 to about 10 lbs. of active solids per ton of dry pulp, or from about 0.5 to 5 lbs. of active solids per ton of dry pulp.

In one embodiment, the microfibrillated cellulose(s) and branched or crosslinked copolymer(s) are added to the pulp slurry at a ratio of from about 10:1 to about 1:10. The total amount of the active solids of the microfibrillated cellulose(s) and the branched or crosslinked copolymer(s) may be added in the range of from about 0.01 to about 0.50 wt % based on the weight of dry pulp.

In one embodiment, the microfibrillated cellulose(s) and branched or crosslinked copolymer(s) are added to the pulp slurry in a ratio of from about 5:1 to about 2:1. The total amount of the active solids of the microfibrillated cellulose(s) and the branched or crosslinked copolymer(s) may be added in the range of from about 0.01 to about 0.15 wt % based on the weight of dry pulp.

In yet another embodiment, it is feasible that the above-described microfibrillated cellulose(s) and branched or crosslinked copolymer(s) may be added to the pulp slurry in the paper machine at a point wherein the pulp slurry is a thick stock.

The presently disclosed and/or claimed inventive concept(s) is sensitive to varying pulp furnish type and quality. One skilled in the art knows that a typical furnish for alkaline free sheet used for printing and writing applications usually possesses relatively little anionic charge when compared to recycled furnish used for a packaging paper product. The alkaline free sheet furnish contains fibers with few contaminants such as, for example but without limitation, anionic trash, lignin, and/or stickies, which commonly possess an anionic charge, while the recycled furnish usually contains significant amounts of these same contaminants. Therefore, a recycled furnish can accommodate greater amounts of cationic additives to enhance the performance of the papermaking process and the paper product itself relative to the alkaline free sheet furnish. Thus, the most useful embodiment(s) of this invention may depend on such critical factors of papermaking such as furnish quality and final product.

Additional Additives

In addition to (a) the at least one microfibrillated cellulose and (b) the at least one associative polymer or the at least one branched or crosslinked copolymer, one or more additional additives can be added to the pulp slurry prior to, during, and/or after the at least one microfibrillated cellulose and/or the at least one associative polymer or the at least one branched or crosslinked copolymer.

The one or more additional additives can include, for example but without limitation, a starch, a conventional flocculant, an aluminum source, and/or combinations thereof.

Starches that may be used in the method of the invention include cationic and amphoteric starches. Suitable starches include those derived from corn, potato, wheat, rice, tapioca, and the like. Cationicity is imparted by the introduction of cationic groups, and amphotericity by the further introduction of anionic groups. For instance, cationic starches may be obtained by reacting starch with tertiary amines or with quaternary ammonium compounds, e.g., dimethylaminoethanol and 3-chloro-2-hydroxypropyltrimethylammonium chloride. Cationic starches preferably have a cationic degree of substitution (D.S.)—i.e., the average number of cationic groups substituted for hydroxyl groups per anhydroglucose unit—of from about 0.01 to about 1.0, more preferably about 0.01 to about 0.10, more preferably about 0.02 to 0.04.

The conventional flocculant can be an anionic, cationic, or nonionic polymer. In one embodiment, the conventional flocculant can be, for example but without limitation, a copolymer comprising (i) an anionic monomer or cationic monomer and (ii) a nonionic monomer. The co-monomers of the conventional flocculant may be present in any ratio. These polymers can be provided by a variety of synthetic processes including, but not limited to, suspension, dispersion and inverse emulsion polymerization. In one embodiment, the conventional flocculant may be a linear cationic or anionic copolymer of acrylamide. The resultant copolymer can be nonionic, cationic, anionic, or amphoteric.

The aluminum sources can be, for example but without limitation, alum (aluminum sulfate), polyaluminum sulfate, polyaluminum chloride, and/or aluminum chlorohydrate.

EXAMPLES

The following examples indicate a possible method of forming an associative polymer using the inverse (water-in-oil) emulsion polymerization process. Additionally, the following examples illustrate (1) the increased drainage performance of a pulp slurry resulting from adding at least one microfibrillated cellulose and at least one associative polymer to the pulp slurry, and (2) the increased drainage performance of a pulp slurry resulting from adding at least one microfibrillated cellulose and at least one branched or crosslinked copolymer to the pulp slurry. These examples are merely illustrative of the presently disclosed and/or claimed inventive concept(s) and are not to be construed as limiting the presently disclosed and/or claimed inventive concept(s) to the particular compounds, processes, conditions, or applications disclosed therein.

Example of Inverse (Water-in-Oil) Emulsion Polymerization Process without a Branching or Crosslinking Agent An oil phase of paraffin oil (156.2 g, Exxsol™ D80 oil, available from Exxon, Houston, Tex.) and emulsification surfactants (5 g Atlas™ G-946 and 10 g Hypermer® B246SF, Croda, New Castle, Del.) were charged to a suitable reaction flask equipped with an overhead mechanical stirrer, thermometer, nitrogen sparge tube, and condenser. The temperature of the oil phase was then adjusted to 40° C.

An aqueous phase was prepared separately which comprised 50 wt % acrylamide solution in water (134.5 g), acrylic acid (68.9 g), deionized water (42.2 g), and Versenex™ 80 (Dow Chemical) chelant solution (0.7 g). The aqueous phase was then adjusted to pH 5.4 with the addition of sodium hydroxide solution in water (45.4 g, 50 wt %). The temperature of the aqueous phase after neutralization was 40° C.

The aqueous phase was then charged to the oil phase while simultaneously being mixed with a homogenizer to obtain a stable water-in-oil emulsion. This emulsion was then mixed with a 4-blade glass stirrer while being sparged with nitrogen for 60 minutes. During the nitrogen sparge, the temperature of the emulsion was adjusted to 57±1° C. Afterwards, the sparge was discontinued and a nitrogen blanket implemented.

The polymerization was initiated by adding a 1 wt % solution of dilauroyl peroxide (LP) in Exxsol™ D80 (0.75 g). This corresponded to an initial LP charge, as LP, of 10 ppm on a total monomer basis. Another 10 ppm of LP were added after 60 minutes, then 20 ppm LP was added after 90 minutes. During the course of the feed, the batch temperature was maintained at 57±1° C. After 180 minutes, a 3 wt % 2,2'-azobisisobutyronitrile (AIBN) solution in toluene (0.085 g) was then charged. This corresponds to a second AIBN charge of 100 ppm on a total monomer basis. Then the batch was held at 62±1° C. for 2 hours. The batch was then cooled to room temperature, and breaker surfactants comprising 1.5% Atlas G-1086 (Croda, New Castle Del.) and 0.5% Tetronic 1301 (BASF, Mount Olilve, N.J.) were added. The resulting copolymer had a storage modulus (G') for a 1.5 wt. % actives polymer solution measured at 6.3 Hz of 365 Pa.

Drainage Performance of Pulp Slurry Treated with at Least One Microfibrillated Cellulose and at Least One Associative Polymer To evaluate the performance of the presently disclosed and/or claimed inventive concept(s), several drainage tests were performed to illustrate the improved drainage performance of a pulp slurry having at least one microfibrillated cellulose and at least one associative polymer added thereto.

The pulp slurry was prepared from hardwood and softwood dried market lap pulps, which were refined separately and then combined at a ratio of from about 70 wt % hardwood to about 30 wt % softwood in an aqueous medium. The aqueous medium comprised a mixture of local hard water and deionized water to a representative hardness. Inorganic salts were added in sufficient amounts to provide the aqueous medium with a total alkalinity of 75 ppm as $CaCO_3$ and hardness of 100 ppm as $CaCO_3$. Precipitated calcium carbonate, Albacar® 5970 available from Minerals Technologies (Bethlehem, Pa.), was introduced into the pulp slurry at a representative weight percent to provide a final pulp slurry containing 80% fiber and 20% precipitated calcium carbonate filler.

The drainage activity of the presently disclosed and/or claimed inventive concept(s) was determined utilizing a modification of the Dynamic Drainage Analyser test equipment available from AB Akribi Kemikonsulter (Sundsvall, Sweden). The modification consisted of substituting the machine's mixing chamber and filtration medium with ones having both a smaller sample volume and cross-sectional area. Specifically, a 250-ml sample volume at 0.5% consistency and a 47-mm cross-sectional filtration diameter (60-mesh screen) were used for all tests for the pulp slurry treated with the at least one microfibrillated cellulose and the at least one associative polymer.

The modified test device applied a 400 mbar vacuum to the bottom of the separation medium for each test and electronically measured the time between the application of vacuum and the vacuum break point, i.e., the time at which the air/water interface passed through the thickening fiber mat. This value was reported as the drainage time. A lower drainage time is preferred.

The various additives to the pulp slurry were added on an active solids basis relative to the dry pulp. Tables 1 and 2 illustrate each additive that was added to the pulp slurry and their respective amounts in pounds per ton (lb/ton) based on an active solids basis relative to the dry pulp. The comparative examples (i.e., pulp slurries not containing at least one microfibrillated cellulose and at least one associative polymer) are distinguished in the tables from the experimental examples (i.e., pulp slurries that do contain at least one microfibrillated cellulose and at least one associative polymer).

The test samples in Tables 1 and 2 were prepared as follows:

First, 10 lb/ton (active solids) of a cationic starch (Sta-Lok® 400 with 100% active solids available from Tate and Lyle, Decatur, Ill.), i.e., the "first additive", was added to the above-described pulp slurry.

Second, 5 lb/ton (active solids) of aluminum sulfate (50% strength available from Delta Chemical, Baltimore, Md.), i.e., the "second additive", was then added to the pulp slurry.

Third, as specified in Tables 1 and 2 below, additional additives, including microfibrillated cellulose and associative polymer for example, were added to the pulp slurry as the "third", "fourth", and "fifth" additives. The additives were added sequentially in the order noted, and allowed to mix ten seconds before the subsequent addition of the next additive.

Lastly, the pulp slurry containing the indicated components was subjected to the drainage measurements using the previously described modified Dynamic Drainage Analyser test equipment. In between each step, the pulp slurry was allowed to mix for 10 seconds at 1200 rpm.

As indicated in the Tables by their commercial or placeholder names, the additives that may be added are:

Perform™ PC 8179, a 40% active solids cationic polyacrylamide commercially available from Solenis (Wilmington, Del.);

PerForm™ SP 7200 and Perform™ SP 7202, anionic charged associative polymers from Solenis (Wilmington, Del.);

CS-1 is a cationic substituted microfibrillated cellulose from UPM Kymmene (Helsinki, Finland) further defined in Table 3 below.

Additionally, as indicated in the tables, the additives may also be one of ASMC-1, ASMC-2, or ASMC-3, which are anionic substituted microfibrillated celluloses ("ASMC") with varying degrees of substitution ("D.S."). In particular, ASMC-1 has a D.S. in a range from about 0.1 to about 0.15, ASMC-2 has a D.S. in a range from about 0.16 to about 0.24, and ASMC-3 has a D.S. in a range of from about 0.16 to 0.24. ASMC-1, ASMC-2, and ASMC-3 have each been modified with carboxyl groups such that ASMC-1 has a charge of 0.8 mmol COOH/g, ASMC-2 has a charge of 1.0 mmol COOH/g, and ASMC-3 has a charge of 1.0 COOH/g. Unless otherwise indicated, the ASMC-1, ASMC-2, and ASMC-3 were provided in gel form.

TABLE 1

As discussed above, for all runs:
First additive = 10 lb/ton Sta-Lok ® 400 cationic starch
Second additive - 5 lb/ton aluminum sulfate

| | Additives | | | Drain |
|---|---|---|---|---|
| Run # | Third Additive (lb/ton) | Fourth Additive (lb/ton) | Fifth Additive (lb/ton) | Time (s) |
| 1 (comparative) | Perform ™ PC 8179 (0.4) | — | — | 42.4 |
| 2 (comparative) | Perform ™ PC 8179 (0.4) | PerForm ™ SP 7202 (0.4) | — | 22.5 |
| 3 (comparative) | Perform ™ PC 8179 (0.4) | ASMC-2 (0.5) | — | 31.6 |
| 4 (comparative) | Perform ™ PC 8179 (0.4) | ASMC-2 (1) | — | 26.0 |
| 5 (comparative) | Perform ™ PC 8179 (0.4) | ASMC-2 (2) | — | 22.2 |
| 6 (comparative) | Perform ™ PC 8179 (0.4) | ASMC-2 (4) | — | 20.3 |
| 7 (comparative) | Perform ™ PC 8179 (0.4) | ASMC-3 (0.5) | — | 33.5 |
| 8 (comparative) | Perform ™ PC 8179 (0.4) | ASMC-3 (1) | — | 24.4 |
| 9 (comparative) | Perform ™ PC 8179 (0.4) | ASMC-3 (2) | — | 25.1 |
| 10 (comparative) | Perform ™ PC 8179 (0.4) | ASMC-3 (4) | — | 26.3 |
| 11 | Perform ™ PC 8179 (0.4) | PerForm ™ SP 7202 (0.4) & ASMC-2 (0.5) | — | 19.1 |
| 12 | Perform ™ PC 8179 (0.4) | PerForm ™ SP 7202 (0.4) & ASMC-2 (1.0) | — | 18.0 |
| 13 | Perform ™ PC 8179 (0.4) | PerForm ™ SP 7202 (0.4) & ASMC-2 (2.0) | — | 17.0 |
| 14 | Perform ™ PC 8179 (0.4) | PerForm ™ SP 7202 (0.4) & ASMC-2 (4.0) | — | 17.1 |

TABLE 1-continued

As discussed above, for all runs:
First additive = 10 lb/ton Sta-Lok ® 400 cationic starch
Second additive - 5 lb/ton aluminum sulfate

| | Additives | | | Drain |
|---|---|---|---|---|
| Run # | Third Additive (lb/ton) | Fourth Additive (lb/ton) | Fifth Additive (lb/ton) | Time (s) |
| 15 | Perform ™ PC 8179 (0.4) | PerForm ™ SP 7202 (0.4) & ASMC-2 (0.5) | — | 19.8 |
| 16 | Perform ™ PC 8179 (0.4) | PerForm ™ SP 7202 (0.4) & ASMC-2 (1.0) | — | 19.1 |
| 17 | Perform ™ PC 8179 (0.4) | PerForm ™ SP 7202 (0.4) & ASMC-2 2.0) | — | 19.6 |
| 18 | Perform ™ PC 8179 (0.4) | PerForm ™ SP 7202 (0.4) & ASMC-2 (4.0) | — | 21.4 |
| 19 | CS-1 (0.5) | PerForm ™ SP 7202 (0.4) | — | 20.1 |
| 20 | CS-1 (1) | PerForm ™ SP 7202 (0.4) | — | 15.6 |
| 21 | CS-1 (2) | PerForm ™ SP 7202 (0.4) | — | 14.1 |
| 22 | CS-1 (4) | PerForm ™ SP 7202 (0.4) | — | 17.7 |
| 23 | Perform ™ PC 8179 (0.4) | CS-1 (0.5) | PerForm ™ SP 7202 (0.4) | 18.2 |
| 24 | Perform ™ PC 8179 (0.4) | CS-1 (1) | PerForm ™ SP 7202 (0.4) | 16.6 |
| 25 | Perform ™ PC 8179 (0.4) | CS-1 (2) | PerForm ™ SP 7202 (0.4) | 16.2 |
| 26 | Perform ™ PC 8179 (0.4) | CS-1 (4) | PerForm ™ SP 7202 (0.4) | 21.6 |
| 27 | CS-1 (0.5) | Perform ™ PC 8179 (0.4) | PerForm ™ SP 7202 (0.4) | 18.6 |
| 28 | CS-1 (1) | Perform ™ PC 8179 (0.4) | PerForm ™ SP 7202 (0.4) | 19.6 |
| 29 | CS-1 (2) | Perform ™ PC 8179 (0.4) | PerForm ™ SP 7202 (0.4) | 20.4 |
| 30 | CS-1 (4) | Perform ™ PC 8179 (0.4) | PerForm ™ SP 7202 (0.4) | 26.3 |
| 31 | Perform ™ PC 8179 (0.4) & CS-1 (0.5) | PerForm ™ SP 7202 (0.4) | — | 28.4 |
| 32 | Perform ™ PC 8179 (0.4) & CS-1 (1.0) | PerForm ™ SP 7202 (0.4) | — | 26.0 |
| 33 | Perform ™ PC 8179 (0.4) & CS-1 (2.0) | PerForm ™ SP 7202 (0.4) | — | 25.0 |
| 34 | Perform ™ PC 8179 (0.4) & CS-1 (4.0) | PerForm ™ SP 7202 (0.4) | — | 35.0 |

The data in Table 1 demonstrates the strong interaction between the associative polymer (PerForm™ SP 7202) and microfibrillated cellulose resulting in improved drainage performance. Runs 11-18 demonstrate that the drainage of the anionic microfibrillated cellulose, ASMC-2 and ASMC-3, added in combination with the associative polymer, PerForm™ SP 7202, is improved as compared to the drainage of comparative Runs 1-10, including Run #2, which only added the associative polymer, PerForm™ SP 7202. Runs 19-22 utilize the cationic substituted microfibrillated cellulose, CS, instead of the cationic flocculant, Perform™ PC 8179, demonstrating improvement over Run #2. The addition of the cationic substituted microfibrillated cellulose, CS, in Runs 27-29 also improves the drainage of the pulp slurry.

The higher drain times in Runs 30-34 are a result of changes to the total furnish charge when Perform™ PC 8179 and CS-1 are added at the same time. With increased levels of cationic additives, in addition to the cationic starch and alum previously added to the furnish, the system charge increases from a net anionic charge towards zero, or becomes a net cationic charge. For example when Perform™ PC 8179 (a 40% active solids cationic polyacrylamide) and CS-1 (a cationic microfibrillated cellulose) are added at the same time, the furnish can undergo self-dispersion, which results in slightly increased drain times. However, as indicated in Runs 11-29, when only a cationic microfibrillated cellulose is used and/or when the cationic microfibrillated cellulose is added separately from another cationic additive (e.g., Perform™ PC 8179), the drainage times are generally lower than the corresponding comparative examples.

TABLE 2

As discussed above, for all runs:
First additive = 10 lb/ton Sta-Lok ® 400 cationic starch
Second additive - 5 lb/ton aluminum sulfate

| Run # | Additives: Third Additive (lb/ton) | Additives: Fourth Additive (lb/ton) | Drain Time (s) |
|---|---|---|---|
| 1 (comparative) | Perform ™ PC 8179 (0.4) | — | 39.3 |
| 2 (comparative) | Perform ™ PC 8179 (0.4) | PerForm ™ SP 7202 | 23.6 |
| 3 | Perform ™ PC 8179 (0.4) | PerForm ™ SP 7202 (0.4) & ASMC-2 (15% powder form) (0.4) | 20.4 |
| 4 | Perform ™ PC 8179 (0.4) | PerForm ™ SP 7202 (0.4) & ASMC-2 (2.5% gel form) (0.4) | 20.7 |
| 5 | Perform ™ PC 8179 (0.4) | PerForm ™ SP 7202 (0.4) & ASMC-1 (2.5% gel form) (0.4) | 21.8 |

The data in Table 2 demonstrates the strong drainage efficiency of pulp slurries comprising an associative polymer, PerForm™ SP 7202, and various physical forms and grades of microfibrillated cellulose due to the interactions between the associative polymer and microfibrillated cellulose. The 2.5% gel form of the anionic substituted microfibrillated cellulose showed no significant difference from the 15% powder form of the anionic substituted microfibrillated cellulose.

Another series of drainage studies were conducted using the same test procedures as specified in Examples 1 and 2, wherein the additives are: (a) one of three cationic microfibrillated celluloses that have different degrees of substitutions (DS) and solid content and (b) an associative polymer, PerForm™ SP7202 available from Solenis (Wilmington, Del.).

The three cationic microfibrillated celluloses are illustrated in Table 3 and the amount of the additives added to the pulp slurry also comprising 10 lb/ton (active solids) of a cationic starch (Sta-Lok® 400 with 100% active solids available from Tate and Lyle, Decatur, Ill.), i.e., the "first additive", and 5 lb/ton (active solids) of aluminum sulfate (50% strength available from Delta Chemical, Baltimore, Md.), i.e., the "second additive", (as discussed above) are presented in Table 4. The amount of the cationic microfibrillated celluloses from Table 3 and associative polymer added to the pulp slurry are also demonstrated in Table 4 in pounds per ton (lb/ton) based on an active solids basis relative to the dry pulp.

TABLE 3

Solid Content and DS of Cationic Microfibrillated Cellulose Additives

| Sample | % Active Solids | DS |
|---|---|---|
| CS-1 | 2.0 | 0.3 |
| CS-2 | 2.2 | 0.2 |
| CS-3 | 2.2 | 0.3 |

The cationic microfibrillated celluloses in Table 3 were each prepared by introduction of ammonium containing groups by chemical glycidyl trialkylammoniumchloride (GTAC) to microfibrillated cellulose.

TABLE 4

As discussed above, for all runs:
First additive = 10 lb/ton Sta-Lok ® 400 cationic starch
Second additive - 5 lb/ton aluminum sulfate

| Run # | Third Additive (lb/ton) | Fourth Additive (lb/ton) | Drain Time (s) |
|---|---|---|---|
| 1 (comparative) | — | PerForm ™ SP 7202 (0.4) | 32.1 |
| 2 | CS-1 (0.5) | PerForm ™ SP 7202 (0.4) | 27.2 |
| 3 | CS-2 (0.5) | PerForm ™ SP 7202 (0.4) | 30.3 |
| 4 | CS-3 (0.5) | PerForm ™ SP 7202 (0.4) | 27.9 |
| 5 | CS-1 (1) | PerForm ™ SP 7202 (0.4) | 22.6 |
| 6 | CS-2 (1) | PerForm ™ SP 7202 (0.4) | 26.4 |
| 7 | CS-3 (1) | PerForm ™ SP 7202 (0.4) | 26.1 |
| 8 | CS-1 (2) | PerForm ™ SP 7202 (0.4) | 18.1 |
| 9 | CS-2 (2) | PerForm ™ SP 7202 (0.4) | 22.7 |
| 10 | CS-3 (2) | PerForm ™ SP 7202 (0.4) | 22.0 |

The data in Table 4 demonstrates the strong interaction between the three cationic microfibrillated celluloses and the associative polymer resulting in improved drainage performance. Runs 2-4 show the drainage of the three cationic microfibrillated celluloses at the level of 0.5 lb/ton are improved over the control program Run #1. Runs 5-7 and 8-10 show the drainage efficacies are further improved with increased levels of the microfibrillated celluloses to 1 lb/ton and 2 lb/ton, respectively.

Drainage Performance of Pulp Slurry Treated with at Least One Microfibrillated Cellulose and at Least One Branched or Crosslinked Copolymer Additionally, to further evaluate the performance of the presently disclosed and/or claimed inventive concept(s), several drainage tests were performed to illustrate the improved drainage performance of a pulp slurry having at least one microfibrillated cellulose and at least one branched or crosslinked copolymer added thereto.

The pulp slurry was prepared in the same manner as described above for the experiments related to the drainage performance of a pulp slurry treated with at least one microfibrillated cellulose and at least one branched or crosslinked copolymer.

The drainage activity of the presently disclosed and/or claimed inventive concept(s) used the same test procedures as above, except with the standard Dynamic Drainage Analyser mixing chamber (15 cm in height and 10 cm in diameter) available from AB Akribi Kemikonsulter (Sundsvall, Sweden). The larger surface area with this mixing chamber provides faster drainage times than the previous examples.

The standard Dynamic Drainage Analyzer applied a 400 mbar vacuum to the bottom of the separation medium for each test and electronically measured the time between the application of vacuum and the vacuum break point, i.e., the time at which the air/water interface passed through the thickening fiber mat. This value was reported as the drainage time. A lower drainage time is preferred.

The various additives to the pulp slurry were added on an active solids basis relative to the dry pulp. Table 5 illustrates each additive that was added to the pulp slurry and their respective amounts in pounds per ton (lb/ton) based on an active solids basis relative to the dry pulp. The comparative examples (i.e., pulp slurries not containing at least one microfibrillated cellulose and at least one branched or crosslinked copolymer) are distinguished in Table 5 from the experimental examples (i.e., pulp slurries that do contain at least one microfibrillated cellulose and at least one branched or crosslinked copolymer).

The test samples in Table 5 were prepared as follows:

First, 10 lb/ton (active solids) of a cationic starch (Sta-Lok® 400 with 100% active solids available from Tate and Lyle, Decatur, Ill.), i.e., the "first additive", was added to the above-described pulp slurry.

Second, 5 lb/ton (active solids) of aluminum sulfate (50% strength available from Delta Chemical, Baltimore, Md.), i.e., the "second additive", was then added to the pulp slurry.

Third, as specified in Table 5 below, additional additives, including at least one microfibrillated cellulose and at least one branched or crosslinked copolymer for example, were added to the pulp slurry as the "third", and "fourth" additives. The additives were added sequentially in the order noted, and allowed to mix ten seconds before the subsequent addition of the next additive.

Lastly, the pulp slurry containing the indicated components was subjected to the drainage measurements using the previously described modified Dynamic Drainage Analyser test equipment. In between each step, the pulp slurry was allowed to mix for 10 seconds at 1200 rpm.

As indicated in the Tables by their commercial or placeholder names, the additives that may be added are:

Anionic substituted microfibrillated cellulose ASMC-2, as described above, having a D.S. in a range of from about 0.16 to about 0.24 and a charge of 1.0 mmol COOH/g;

A commercial branched or crosslinked copolymer, Telioform® M100 available from BASF (Ludwigshaven, Germany);

Perform™ PC 8179, a 40% active solids cationic polyacrylamide commercially available from Solenis (Wilmington, Del.).

The data in Table 5 demonstrates the strong drainage interaction between an anionic microfibrillated cellulose and a branched or crosslinked copolymer.

TABLE 5

As discussed above, for all runs:
First additive = 10 lb/ton Sta-Lok ® 400 cationic starch
Second additive - 5 lb/ton aluminum sulfate

| | Additives | | Drain |
|---|---|---|---|
| Run # | Third Additive (lb/ton) | Fourth Additive (lb/ton) | Time (s) |
| 1 (comparative) | Perform ™ PC 8179 (0.4) | Telioform ® M100 (0.3) | 5.2 |

TABLE 5-continued

As discussed above, for all runs:
First additive = 10 lb/ton Sta-Lok ® 400 cationic starch
Second additive - 5 lb/ton aluminum sulfate

| | Additives | | Drain |
|---|---|---|---|
| Run # | Third Additive (lb/ton) | Fourth Additive (lb/ton) | Time (s) |
| 2 | Perform ™ PC 8179 (0.4) | Telioform ® M100 (0.3) & ASMC-2 (0.5) | 4.98 |
| 3 | Perform ™ PC 8179 (0.4) | Telioform ® M100 (0.3) & ASMC-2 (1.0) | 4.73 |
| 4 | Perform ™ PC 8179 (0.4) | Telioform ® M100 (0.3) & ASMC-2 (2.0) | 4.53 |

The data in Table 5 demonstrates the strong drainage interaction between an anionic microfibrillated cellulose and a branched or crosslinked copolymer.

Thus, a method of increasing the drainage performance of a pulp slurry during a papermaking process is disclosed herein. While embodiments of the presently disclosed and/or claimed concept(s) have been shown and described, it will be apparent to those skilled in the art that many more modifications are possible without departing from the inventive concept(s) herein.

What is claimed is:

1. A method for increasing the drainage performance of a pulp slurry, comprising adding (a) at least one microfibrillated cellulose and (b) at least one associative polymer to a pulp slurry, wherein the at least one microfibrillated cellulose and the at least one associative polymer are added at a ratio of from about 10:1 to about 1:10 of the at least one microfibrillated cellulose to the at least one associative polymer.

2. The method of claim 1, wherein the pulp slurry is present in a wet end of a paper machine prior to adding the at least one microfibrillated cellulose and the at least one associative polymer to the pulp slurry.

3. The method of claim 1, wherein the at least one microfibrillated cellulose and the at least one associative polymer are added to the pulp slurry to form a mixture, and then introducing the mixture to a paper machine.

4. The method of claim 1, wherein the active solids of the at least one microfibrillated cellulose and the at least one associative polymer are present in the pulp slurry at a range of from about 0.01 wt % to about 1 wt % based on the weight of dry pulp in the pulp slurry.

5. The method of claim 1, wherein the active solids of the at least one microfibrillated cellulose and the at least one associative polymer are present in the pulp slurry at a range of from about 0.01 wt % to about 0.5 wt % based on the weight of dry pulp in the pulp slurry.

6. The method of claim 1, wherein the at least one microfibrillated cellulose and the at least one associative polymer are added at a ratio of from about 5:1 to about 1:2 of the at least one microfibrillated cellulose to the at least one associative polymer.

7. The method of claim 6, wherein the active solids of the at least one microfibrillated cellulose and the at least one associative polymer are present in the pulp slurry at a range of from about 0.01 wt % to about 0.15 wt % based on the weight of dry pulp in the pulp slurry.

8. The method of claim 1, wherein the at least one microfibrillated cellulose is derivatized microfibrillated cellulose having an anionic charge.

9. The method of claim 8, wherein the derivatized microfibrillated cellulose has a degree of substitution in a range of from about 0.02 to about 0.50.

10. The method of claim 8, wherein the derivatized microfibrillated cellulose has a degree of substitution in a range of from about 0.10 to about 0.35.

11. The method of claim 8, wherein the derivatized microfibrillated cellulose has a degree of substitution in a range of from about 0.1 to about 0.25.

12. The method claim 1, wherein the at least one microfibrillated cellulose is derivatized microfibrillated cellulose having a cationic charge.

13. The method of claim 12, wherein the derivatized microfibrillated cellulose has a degree of substitution in a range of from about 0.02 to about 0.50.

14. The method of claim 12, wherein the derivatized microfibrillated cellulose has a degree of substitution in a range of from about 0.10 to about 0.35.

15. The method of claim 1, wherein the at least one associative polymer is an anionic copolymer comprising the formula (I):

$$-[\text{B-co-F}]- \quad \text{(I)}$$

wherein B is a nonionic polymer segment comprising one or more ethylenically unsaturated nonionic monomers; F is an anionic polymer segment comprising one or more ethylenically unsaturated anionic monomers; and the molar percent ratio of B:F is in a range of from about 95:5 to about 5:95.

16. The method of claim 1, wherein the at least one microfibrillated cellulose and the at least one associative polymer are added at a ratio of from about 10:1 to about 5:4 of the at least one microfibrillated cellulose to the at least one associative polymer.

17. A paper product comprising (a) cellulose pulp, (b) at least one microfibrillated cellulose, and (c) at least one associative polymer.

* * * * *